US007708211B2

(12) United States Patent
Maier et al.

(10) Patent No.: US 7,708,211 B2
(45) Date of Patent: May 4, 2010

(54) NOZZLE FOR THE DISCHARGE OF A FLOWABLE SUBSTANCE

(75) Inventors: Hans-Joerg Maier, Waghaeusel 2 (DE); Michael Schaetzle, Walldorf (DE)

(73) Assignee: Henkel KGaA (DE)

( * ) Notice: Subject to any disclaimer, the term of this patent is extended or adjusted under 35 U.S.C. 154(b) by 247 days.

(21) Appl. No.: 11/682,917

(22) Filed: Mar. 7, 2007

(65) Prior Publication Data

US 2007/0210187 A1 Sep. 13, 2007

Related U.S. Application Data

(63) Continuation of application No. PCT/EP2005/009115, filed on Aug. 24, 2005.

(30) Foreign Application Priority Data

Sep. 7, 2004 (DE) ..... 10 2004 043 111

(51) Int. Cl.
*B05B 1/32* (2006.01)

(52) U.S. Cl. ..... 239/456; 239/438; 239/507; 239/513; 239/597; 239/600; 239/601; 222/502; 222/507; 222/519

(58) Field of Classification Search ..... 239/436–438, 239/456–458, 504, 507, 513–515, 546, 597, 239/600, 601; 222/502, 503, 507, 509, 522, 222/525, 566, 519, 520, 521, 524
See application file for complete search history.

(56) References Cited

U.S. PATENT DOCUMENTS

| | | | | |
|---|---|---|---|---|
| 186,310 | A * | 1/1877 | Curtis | 239/546 |
| 2,135,237 | A * | 11/1938 | Lewis et al. | 222/507 |
| 2,665,826 | A * | 1/1954 | Mahoney | 222/422 |
| 3,186,645 | A * | 6/1965 | Eberlein | 239/513 |
| 6,135,318 | A * | 10/2000 | Valley | 222/521 |
| 6,299,034 | B1 | 10/2001 | Tancheff | |
| 6,328,185 | B1 * | 12/2001 | Stern et al. | 239/438 |

FOREIGN PATENT DOCUMENTS

| | | | |
|---|---|---|---|
| DE | 33 10 447 | A1 | 10/1983 |
| DE | 86 25 509.6 | U1 | 12/1986 |
| DE | 295 00 094.5 | U1 | 4/1995 |
| DE | 100 40 512 | A1 | 3/2002 |
| GB | 2 196 273 | A | 4/1988 |
| WO | 97/41968 | A1 | 11/1997 |

OTHER PUBLICATIONS

International Search Report of PCT/EP2005/009115, dated Nov. 11, 2005.

* cited by examiner

*Primary Examiner*—Steven J Ganey
(74) *Attorney, Agent, or Firm*—James E. Piotrowski

(57) ABSTRACT

A nozzle for the discharge of a flowable substances, for example adhesive or sealing compositions, having a discharge orifice with a variable geometry. The adjustable nozzle permits the user to select the optimal discharge profile suited to a particular application of the composition being discharged.

20 Claims, 4 Drawing Sheets

NOZZLE FOR THE DISCHARGE OF A FLOWABLE SUBSTANCE

CROSS REFERENCE TO RELATED APPLICATIONS

This application is a continuation under 35 U.S.C. §365(c) and 35 U.S.C. §120 of international application PCT/EP2005/009115, filed on Aug. 24, 2005. This application also claims priority under 35 U.S.C. §119 of DE 10 2004 043 111.6, filed Sep. 7, 2004, which is incorporated herein by reference in its entirety.

BACKGROUND OF THE INVENTION

The invention relates to a nozzle for the discharge of a flowable substance, preferably a liquid or pasty adhesive and/or sealing compound, in particular for glazing window glasses for motor vehicles. Said nozzle comprises a nozzle tip that is provided with an orifice for the outlet of the substance. The opening thereof has a longitudinal extension in the direction of the nozzle, preferably forming an essentially triangular or V-shaped profile.

A fixed nozzle of this type is disclosed by the German Utility Model G 8625509.6. This Utility Model relates to a nozzle for the production of a special profile for the direct glazing of windscreens.

In principle, this utility model emanates from a generic nozzle, wherein the opening of the orifice has a triangular profile. A strand of material is delivered through the triangular profile of the orifice to produce, for example a seal when glazing a windscreen. The width of the base of the triangular profile and the height of the triangle are matched to the respective constructional situation. The width of the overlapping surfaces of the objects to be sealed, and the width of the gap between these objects for example, determine the geometry of the triangular profile. The principal design of the orifice profile is not illustrated in the cited Utility Model, as the object set in this Utility Model and the presented solution dealt with other aspects.

However, a nozzle for cartridges can be found, for example, in the German patent application DE 100 40 512, where it is explained that the outlet opening of the nozzle is produced in such a way that a sealed tip of the nozzle body is cut off, whereby an outlet opening with a circular or elliptical cross section is produced depending on the cutting angle. The opening profile of the orifice, otherwise known as the orifice profile, has therefore not only an extension perpendicular to the body of the nozzle, but preferably also a certain lengthwise extension. As the body of the nozzle considered in the DE 100 40 512 is essentially about conical in shape, the first cut to open the nozzle body produces a conical section as the orifice profile, namely a circle or preferably a more or less lengthwise elongated elliptical shape. Also, in principle, the previously mentioned triangular shape for an orifice profile can be produced by a corresponding cut of a nozzle body, whereby the best geometry of the orifice profile for the application purpose can be individually produced by cutting the nozzle body. However, this assumes that the person who cuts the nozzle body is both experienced and manually skilled. In particular, such a cut is irreversible and might not be correctable, if, for example, the opening profile is made too big. This can lead to the nozzle cut in this way being no longer useable and therefore has to be thrown away and replaced by a new nozzle. Also, after the first use-tests, the nozzle cut in this way can reveal that it does not, however, have the optimal geometry for the application purpose, with the result that even with a nozzle cut that was initially assumed correct, this nozzle nevertheless has to be replaced by another nozzle. If several of this type of sample attempts are needed in order to get a feel for the correct geometry, then even a larger number of nozzles could be needed until the actual work, e.g. the glazing, can be finally carried out correctly.

DESCRIPTION OF THE INVENTION

Accordingly, the invention is based on the object of disclosing a nozzle that can be quickly prepared and optimized for the respective application purpose with little resources.

According to the invention, this object is achieved by a positionable control element for varying the geometry of the opening of the orifice.

According to the invention, the nozzle body and the nozzle tip can therefore be relatively approximately pre-cut, which in principal could also be done by a person with little experience and less manual skill, because according to the invention, an control element is provided with which the geometry of the opening of the orifice can also be subsequently varied. In particular, the orifice opening could even turn out to be somewhat too big for the application purpose, because a certain percentage of the orifice could be subsequently covered up by means of the adjusting element. Also, the orifice can even still be optimized by varying the orifice profile as the nozzle is being used. It can also happen that for example the geometry along a sealing gap being prepared must also be varied, with the result that it can be anyway required during the use to also alter the orifice geometry to match. It should be particularly emphasized once again here, that according to the invention, both the clearance, that means the profile of the opening of the orifice, as well as its shape can be varied with the control element. For example, by a suitable design of the control element, it can be possible to make a more triangular opening profile from an initially more oval orifice profile.

According to the invention, however, it is possible not only to pre-cut relatively approximately an orifice, that is shortly before using the nozzle, to actually cut it off and equip it with an orifice, but rather according to the invention instead of this it is preferably intended that the nozzle be equipped from the outset with a ready-made orifice. The orifice accordingly already receives, for example, an optimized machine-cut geometry that can be varied by the control element that itself is also ready-made, into the respective possible variations of the application. For example, the element can be simply a fixable union sleeve that can be made to change position in the nozzle direction. Prior to a one-time use, this can be matched to the actual application purpose and installed and fixed in the correct position.

According to the invention, however, it is preferred that even after installation, the position of the control element can always be changed and can be fixed in different positions. Preferably, the control element can thus be continuously adjusted.

Preferably, the control element also has its own opening profile. This opening profile should preferably correlate with the opening profile of the orifice. This means that when the orifice possesses for example, a triangular opening profile, then the opening profile of the control element is also preferably triangularly shaped, when these profiles do not also have to be necessarily congruent or similar. In fact, according to a further development of the invention, it is preferred that the angle of opening of the opening profile of the control element is greater than the angle of opening of the opening profile of the orifice. In particular, the opening profile of the orifice can be designed narrower and longer, whereas the opening profile of the control element is formed wider and shorter, therefore deeper, so to speak. Through this, there results a variation possibility, which can be particularly advantageous, in that the dispensed material strand flows preferentially and as fast as possible to the place where it is intended to be placed and consequently, due to the geometry, spreads out in this area in an optimal manner.

The inventive opening profile, namely the opening profile of the orifice and/or the opening profile of the control element, can have in a section a U-shape, therefore a partially oval shape, or a V-shape, therefore an angled or angular shape, wherein, however, according to a preferred development of the invention the opening profile on opposite sides to each other has both a U-shape as well as a V-shape. Both these profile shapes can run diagonally on top of each other in the direction of the flowable substance. A sort of plateau or a residual cross section of the nozzle tip can remain between both profile sections, i.e. perpendicular to the circular segments pointing towards the nozzle tip, and which connect each of both the profile sides with one another. In this way a material strand can be advantageously produced, which is optimized in three dimensions in its geometry and purpose.

A further development of the invention arranges that a V-shape or triangular shape of an opening profile could be differently realized. For example, the outer surface of the nozzle tip that can be conically shaped, for example, could have a triangular notch running towards its base, such that a V-shape is produced, in which the cut surfaces running through the nozzle material are essentially facing each other and each run straight and without bends. However, a V-shape can also result from the assembled profile sections, namely in that the nozzle tip is firstly cut diagonally, i.e. firstly a piece broadly follows an elliptical shape and in that moreover on one edge of the resulting ellipse then follows the previously hidden V-shaped notch in the surface of the cone. This does not result in a pure triangular shape, but in a V-shape, in which the upper sections of the side firstly follow rather a U-shape and then, at their lower ends run towards each other in a triangularly shaped tip. In this way the section of the upper U-progression and the lower triangular progression are not located in one plane, but rather at an angle to one another. The cut surfaces of the above U-shape are also not facing each other, but largely point in the outlet direction of the flowable substance, i.e. almost gape open.

Such a somewhat bizarre shape can also contribute to an optimal shape of the strand, firstly by facilitating the outlet of the strand from the nozzle and subordinately shaping the strand such that it is formed in an optimal volume-filling manner.

The adjustable control element can be designed in different ways to be movably positionable and fixable. For example, the control element can be fixable in different positions by friction locking, wherein a fastening screw, e.g. a headless screw could be provided or also a press fit connector, e.g. with a screw running round a union sleeve, which radially presses a cone or a strap onto a press fit connector.

The control element can also by fixable by positive locking, for which particularly a grating can be provided. For this, cooperation between a locking notch and an open notch can be considered. Also, for this a fastening screw, for example with fastening holes, can be considered or e.g. also a type of ratchet.

BRIEF DESCRIPTION OF THE DRAWINGS

Embodiments, from which further inventive features result, are illustrated in the drawing. The drawings show.

DETAILED DESCRIPTION OF THE DRAWINGS

Figure 1:
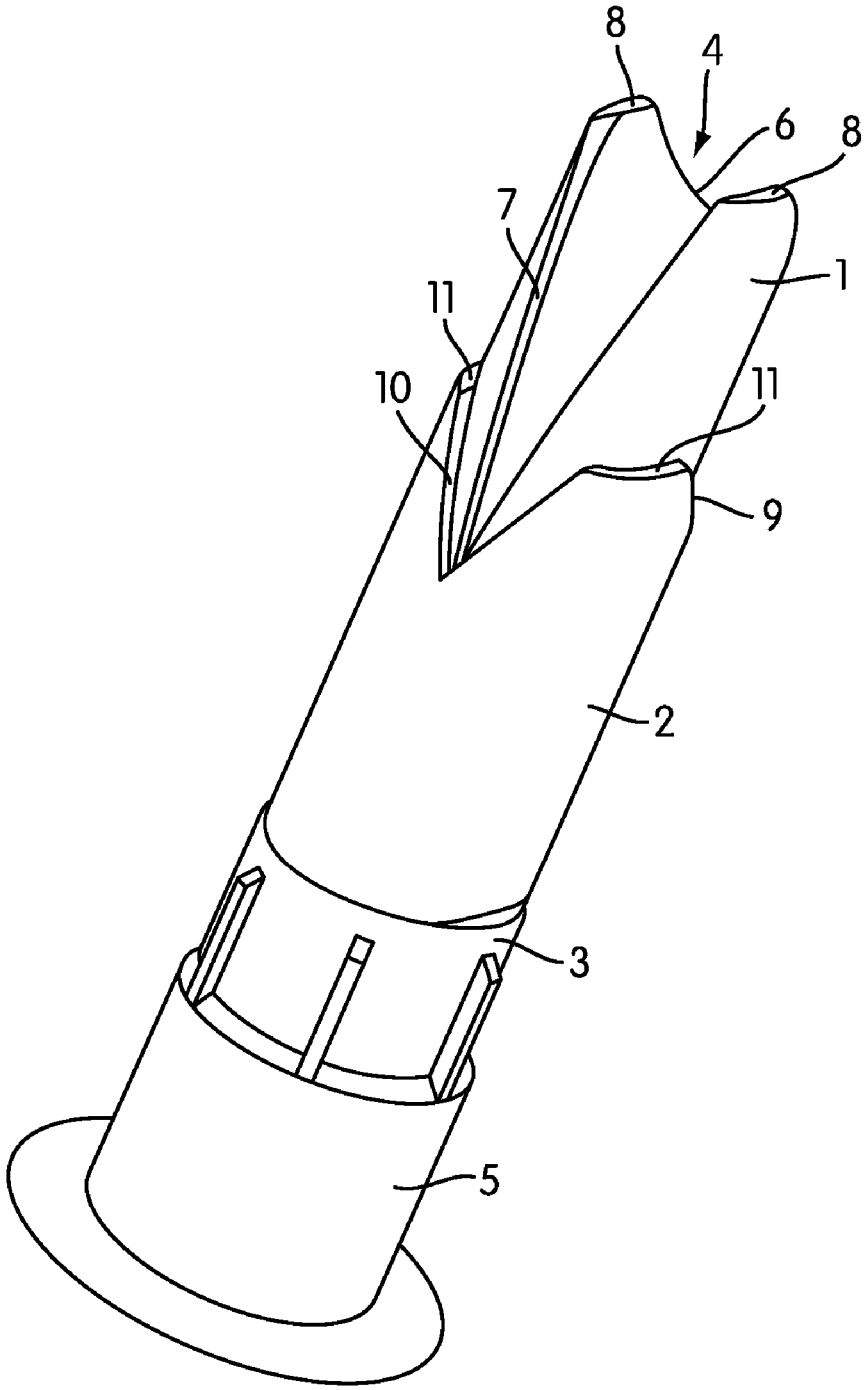
FIG. 1 a first embodiment of an inventive nozzle with a union sleeve in perspective view, FIG. 2 a frontal view of the nozzle of FIG. 1 without the union sleeve, FIG. 3 a first possible side view of the nozzle of FIG. 2, FIG. 4 a second possible side view of the nozzle of FIG. 2, FIG. 5 a top view of the nozzle of FIG. 2, FIG. 6 a possible side view of the union sleeve of FIG. 1, FIG. 7 a top view of the union sleeve of FIG. 6, FIG. 8 a frontal view of the union sleeve of FIG. 6 and FIG. 9 another embodiment of a union sleeve with a modified opening profile.

FIG. 1 shows a first embodiment of an inventive nozzle in a perspective view.

The nozzle essentially comprises a nozzle tip 1 and union sleeve 2 pushed over the nozzle tip 1. This union sleeve 2 can be adjusted along the nozzle tip and fixed with a fastening screw 3.

The nozzle tip 1 has an orifice 4 on one (i.e., distal) end for the outlet of a flowable substance, and at its other (i.e., proximal) end an internally threaded section 5, with which it can be screwed onto a thread of a cartouche, cartridge, or the like, for example.

For the outlet of the substance, the orifice 4 has an opening profile that is composed of various sections. This opening profile includes a U-shape 6, a V-shape 7 on opposite sides of the nozzle tip 1 and a sort of plateau section 8 that consists of circular segments that link the sides of the profile section 6 and 7 to one another.

The union sleeve 2 has a similar opening profile, namely consisting of a U-shape 9, a V-shape 10 and a plateau section 11. In particular, the opening angle of the V-shape 10 is greater than the opening angle of the V-shape 7. By moving the union sleeve 2 along the nozzle tip 1, the clearance (i.e., size) of the opening of the orifice 4 that provides the outlet of the substance can be changed, both in its surface area and in its geometrical shape.

Figure 2:
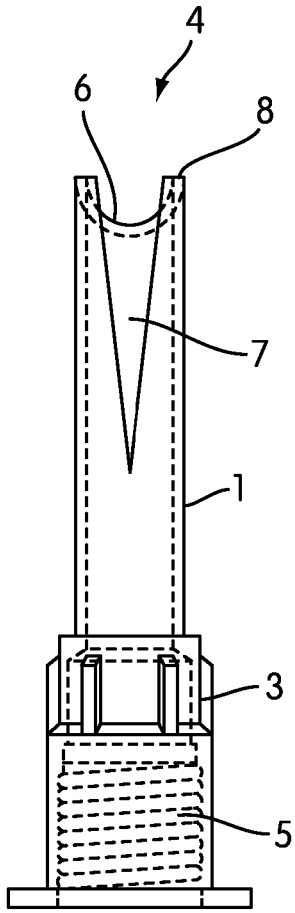

FIG. 2 shows a frontal view of the nozzle tip 1 of FIG. 1. Identical components are designated, as in the other Figures, with the same reference numerals as in FIG. 1.

In particular, one can identify once again the various profile sections of the orifice 4, as well as a view into the internal threaded section 5 by the dashed lines.

Figure 3:
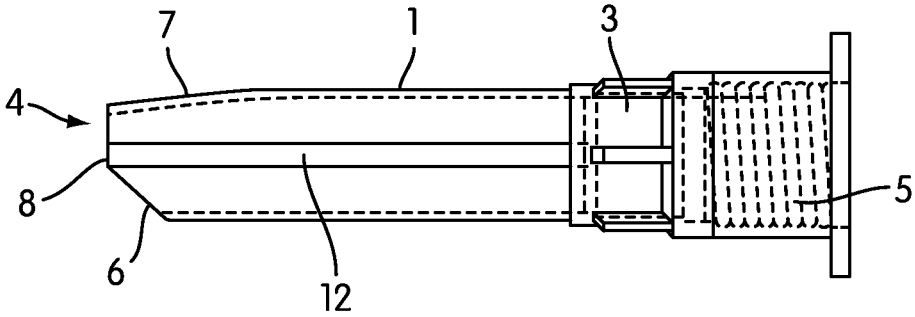

FIG. 3 shows a side view of the nozzle tip 1 of FIG. 2. In this illustration, one's attention should be turned to a flattened guide way 12 that serves as the guide for the union sleeve 2 and simultaneously can also be utilized for constituting a friction locking of the union sleeve.

Figure 4:
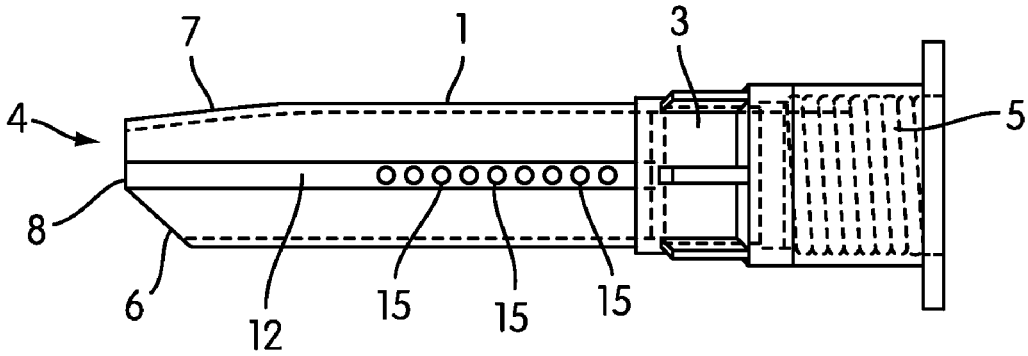

FIG. 4 shows an alternative side view of a nozzle tip 1, which also shows a flattened guide way 12, that however has a grating in the form of equidistantly arranged catching blind holes 15. A fastening screw 14 of FIG. 9, for example, can be inserted into such catching blind holes 15.

Figure 5:
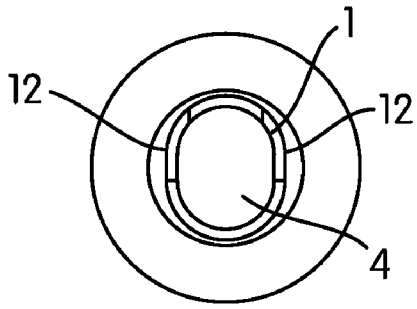

In the top view illustrated in FIG. 5, the nozzle tip 1, by means of this flat guide way 12, obtains, at least in the upper part, a dihedral shape, i.e. a non-circular shape, onto which the union sleeve 2 also matches, such that the union sleeve 2 is not only well guided and secure, but is also torsionally locked. In particular, this ensures that when the union sleeve 2 is moved, the summits of the V-shapes 7 and 10 always lie on an axially parallel line and do not screw up against one another.

Figure 6:
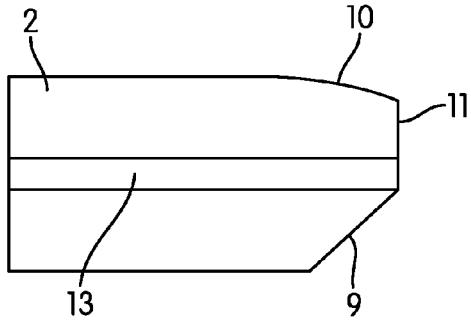
Figure 7:
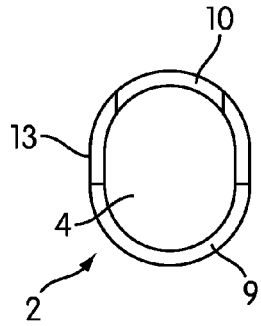
Figure 8:
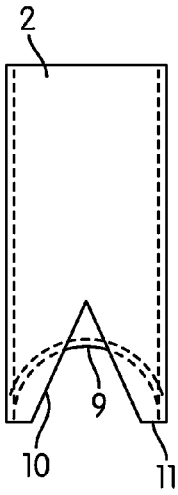

The union sleeve 2 of FIG. 1 is illustrated in FIGS. 6 and 8 in a top view and in a frontal view. In FIG. 6, one can observe that the union sleeve 2 also has a flat portion 13 that also means, as can be seen in the top view of FIG. 7, that in the cross section it is in the shape of a dihedron.

In the frontal view 8 of the union sleeve 2, the opening profile sections 9, 10 and 11 of the union sleeve 2 can be seen from another viewpoint.

Figure 9:
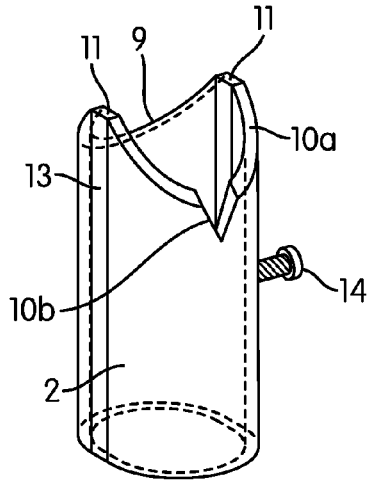

FIG. 9 shows a perspective view of a further embodiment of a union sleeve 2. This embodiment also has an opening profile from a plurality of sections. Again, a U-shape is present, as well as a plateau 11 and also a V-shape 10 is present in principle, however this is now composed of two sections 10*a* and 10*b*. The upper section 10*a* rather follows a U-shape but is then prolonged by the V-tip shaped section 10*b*. In this way the V-section 10 is not located in a plane, but is angled into it.

Furthermore, a simple fastening screw 14 for fixing the union sleeve 2 to a guide way is also indicated in FIG. 9.

LIST OF REFERENCE NUMERALS

1 Nozzle tip
2 Union sleeve
3 Fastening screw
4 Orifice
5 Internal threaded section
6 U-shape
7 V-shape
8 Plateau section
9 U-shape
10 V-shape
11 Plateau
12 Guide way
13 Guide way
14 Fastening screw
15 Catching blind holes As used herein, and in particular as used herein to define the elements of the claims that follow, the articles "a" and "an" are synonymous and used interchangeably with "at least one" or "one or more," disclosing or encompassing both the singular and the plural, unless specifically defined otherwise. The conjunction "or" is used herein in its inclusive disjunctive sense, such that phrases formed by terms conjoined by "or" disclose or encompass each term alone as well as any combination of terms so conjoined, unless specifically defined otherwise.

What is claimed is:

1. A nozzle for the discharge of a strand of a flowable substance through an outlet, said nozzle comprising:

a nozzle tip having an elonoated body terminating at a distal end, an orifice defined in the distal end and extending longitudinally along a section of the body and having a selected opening geometry; and a control element disposed on the body and having an orifice adjacent a first end and extending longitudinally along a section of the control element, wherein the nozzle tip orifice and the control element orifice form the nozzle outlet and the control element is manually moveable by a user toward the nozzle tip distal end to selectively cover the nozzle tip orifice and thereby vary the shape of the outlet through which the strand is discharged.

2. The nozzle of claim 1, wherein one of the nozzle tip orifice or the control element orifice is provided with a ready-made opening profile.

3. The nozzle of claim 1, wherein the longitudinally extending nozzle tip orifice has an essentially triangular or V-shaped profile.

4. The nozzle of claim 3, wherein the longitudinally extending control element orifice has an essentially V-shaped or triangular opening profile that is rotationally alignable with the longitudinally extending nozzle tip orifices.

5. The nozzle of claim 1, wherein the control element is a sleeve disposed completely around the nozzle tip body whose position can be changed longitudinally relative to the nozzle tip distal end and fixed.

6. The nozzle of claim 1, wherein the control element orifice defines an opening profile having a U-shape.

7. The nozzle of claim 6, wherein a U-shape and a V-shape are provided on opposite sides of the nozzle facing away from each other, said U- and V-shapes running diagonally towards each other to a distal end of the nozzle.

8. The nozzle of claim 7, wherein the nozzle tip orifice has an opening profile, the control element orifice has an opening profile and between the opening profiles that run towards each other at the distal end of the nozzle, a plateau remains in the shape of circular segments linking the sides of the oppositely facing opening profiles.

9. The nozzle of claim 1, wherein the control element orifice defines an opening profile, the nozzle tip orifice has an opening profile and at least one of the control element opening profile or the nozzle tip opening profile has a longitudinally oriented V-shape.

10. The nozzle of claim 9, wherein the nozzle tip opening profile or the control element opening profile is cut off in a first partial section essentially diagonally to a longitudinal axis of the nozzle to form a V-shape, and is continued in a second partial section inside a side wall forming a notch for forming the tip of the V-shape of the opening profile.

11. The nozzle of claim 9, wherein a U-shape and a V-shape are provided on opposite sides of the nozzle facing away from each other, said U- and V-shapes running diagonally towards each other to a distal end of the nozzle.

12. The nozzle of claim 1, wherein a press fit connector is provided for fixing the control element position.

13. The nozzle of claim 1 further comprising a screw radially penetrating the control element and positionable against the nozzle tip to fix the control element in a longitudinal position relative to the nozzle tip.

14. The nozzle of claim 1 wherein the control element longitudinally extending orifice is rotationally aligned with the nozzle tip orifice, the bead of substance being discharged through the nozzle tip orifice and the control element longitudinally extending orifice.

15. The nozzle of claim 1 wherein the control element is rotationally fixed with respect to the nozzle tip but longitudinally moveable with respect to the nozzle tip.

16. A nozzle for the discharge of a strand of flowable substance through an outlet, comprising:

an elongated inner tip having a wall defining an internal space fluidly connecting opposing open, distal and proximal ends, the distal end defining an aperture that extends along a section of the wall toward the proximal end, the aperture fluidly connected to the internal space;

a sleeve having a wall defining an internal space connecting opposing open, distal and proximal ends, the distal end defining an aperture that extends along a section of the wall toward the proximal end, the aperture fluidly connected to the internal space, the sleeve disposed over the inner tip, the sleeve aperture fluidly connected to the inner tip aperture and the inner tip internal space;

wherein longitudinal movement of the sleeve toward the inner tip distal end aligns portions of the sleeve aperture extending along a section of the wall with the inner tip aperture extending along a section of the inner tip wall to vary shape of the strand of discharged substance.

17. A nozzle for the discharge of a strand of a flowable substance in a plurality of user controllable shapes, comprising:

a nozzle tip having a distal end defining an orifice, a proximal end defining an aperture, an elongated, hollow body connecting the distal and proximal ends, the body defining an internal space fluidly connecting the distal orifice and the proximal aperture and having an opening along a section of the body connecting to the distal orifice and to the internal space and extending toward the proximal end, the distal orifice and the body opening defining a nozzle tip opening profile; and a control element having a distal end defining an orifice, a proximal end defining an aperture and an elongated, hollow sleeve connecting the distal and proximal ends, the control element orifice defining a sleeve opening profile, the sleeve disposed around the nozzle tip body and the control element proximal end disposed between the nozzle tip distal and proximal ends for movement toward the nozzle tip distal end, the sleeve opening profile rotationally alignable with the nozzle tip opening profile and when so aligned the sleeve opening profile is fluidly connected to the nozzle tip opening and the nozzle tip internal space;

wherein the nozzle tip opening profile and sleeve opening profile define a nozzle opening profile; flowable substance can flow from a container attachable to the nozzle tip proximal end through the internal space and be discharged through the nozzle opening profile and longitudinal positioning of the control element with respect to the nozzle tip distal end changes the shape of the nozzle opening profile to allow a user to adjust the shape of the strand of flowable material discharged from the nozzle opening profile.

18. The nozzle of claim 17 wherein the control element is rotationally fixed with respect to the nozzle tip but longitudinally moveable with respect to the nozzle tip.

19. The nozzle of claim 17 wherein the nozzle tip body and control element sleeve are oval in cross section.

20. The nozzle of claim 17 wherein the control element comprises an opening along a section of the sleeve connecting to the control element orifice and extending toward the proximal end, the control element orifice and opening defining the sleeve opening profile.

* * * * *